US008890797B2

(12) United States Patent
Gondo

(10) Patent No.: US 8,890,797 B2
(45) Date of Patent: Nov. 18, 2014

(54) DISPLAY DEVICE

(75) Inventor: Kenji Gondo, Tokyo (JP)

(73) Assignee: OPTREX Corporation, Tokyo (JP)

( * ) Notice: Subject to any disclaimer, the term of this patent is extended or adjusted under 35 U.S.C. 154(b) by 325 days.

(21) Appl. No.: 13/402,637

(22) Filed: Feb. 22, 2012

(65) Prior Publication Data

US 2012/0147068 A1 Jun. 14, 2012

Related U.S. Application Data

(63) Continuation of application No. PCT/JP2010/064098, filed on Aug. 20, 2010.

(30) Foreign Application Priority Data

Aug. 31, 2009 (JP) ..... 2009-199174

(51) Int. Cl.
*G09G 3/36* (2006.01)
*G09G 3/34* (2006.01)

(52) U.S. Cl.
CPC ..... *G09G 3/3406* (2013.01); *G09G 2360/16* (2013.01); *G09G 3/3611* (2013.01); *G09G 2360/144* (2013.01); *G09G 2320/064* (2013.01); *G09G 2340/0435* (2013.01)
USPC ..... 345/102; 345/77; 345/89; 345/690; 362/600; 362/97.2; 349/65; 349/69

(58) Field of Classification Search
CPC ..... G09G 3/3406; G09G 2360/062; G09G 2360/0653; G09G 2360/0233
USPC ..... 345/77, 89, 102, 207, 690–691; 362/600, 97.2; 349/65, 69
See application file for complete search history.

(56) References Cited

U.S. PATENT DOCUMENTS 6,798,395 B1 * 9/2004 Yamauchi et al. ..... 345/102
(Continued)

FOREIGN PATENT DOCUMENTS

JP 11-316566 11/1999
JP 2000-111870 4/2000
(Continued)

OTHER PUBLICATIONS

English translation of the International Preliminary Report on Patentability and Written Opinion of the International Searching Authority issued Mar. 22, 2012, in PCT/JP2010/064098, filed Aug. 20, 2010.
International Search Report issued on Sep. 14, 2010 for PCT/JP2010/064098 filed on Aug. 20, 2010.

*Primary Examiner* — Lun-Yi Lao
*Assistant Examiner* — Md Saiful A Siddiqui
(74) *Attorney, Agent, or Firm* — Oblon, Spivak, McClelland, Maier & Neustadt, L.L.P.

(57) ABSTRACT

A display device includes an illuminance sensor for detecting an illuminance in a surrounding environment, an input average luminance detection circuit for detecting an average luminance of input images, a frame insertion control circuit for producing a gray image frame and inserting the produced gray image frame into between an input image frame and its subsequently input image frame input, and an insertion luminance level generation circuit for determining a luminance of the gray image frame according to the illuminance detected by the illuminance sensor and the average luminance of the input images detected by the input average luminance detection circuit.

5 Claims, 6 Drawing Sheets

(56) References Cited

U.S. PATENT DOCUMENTS

| | | | | |
|---|---|---|---|---|
| 2005/0264549 | A1* | 12/2005 | Mizumaki | 345/204 |
| 2006/0132424 | A1* | 6/2006 | Foo et al. | 345/102 |
| 2008/0204642 | A1 | 8/2008 | Kobashi | |
| 2009/0184916 | A1 | 7/2009 | Miyazaki et al. | |
| 2009/0219244 | A1* | 9/2009 | Fletcher et al. | 345/102 |
| 2010/0177029 | A1* | 7/2010 | Yeh | 345/102 |

FOREIGN PATENT DOCUMENTS

| | | |
|---|---|---|
| JP | 2002-41002 | 2/2002 |
| JP | 2003-298879 | 10/2003 |
| JP | 2007-078923 | 3/2007 |
| JP | 2007-93832 | 4/2007 |
| JP | 2008-209558 | 9/2008 |
| WO | 2008-102826 | 8/2008 |

* cited by examiner

DISPLAY DEVICE

TECHNICAL FIELD

The present invention relates to a display device, such as a liquid crystal display device, in particular to a display device which is capable of maintaining, at a high level, display quality recognized by a viewer regardless of a change in the illuminance in a surrounding environment.

BACKGROUND ART

When a display device, such as a liquid crystal display device, is used under a bright environment, for example when such a display device is used under an environment where daylight enters, such external light reflects off the screen of the display device, reducing visibility. As the system for preventing such a reduction in visibility, there is a system for controlling the luminance of a backlight in a transmissive display device (for example, see Patent Document 1).

Further, in order to improve the luminance of a color display device, there is a technique where a single pixel is not constituted by three sub-pixels in R (red), G (green) and B (blue) but is constituted by four sub-pixels in R, G, B and W (white) (for example, see Patent Document 2). In a display device where a single pixel is constituted by four sub-pixels in R, G, B and W, the luminance of display is improved regardless of a surrounding environment, resulting in preventing a reduction in visibility when the display device is used under a bright environment.

As the liquid crystal display device for displaying video images, there is a display device which is configured to supply the display panel with signals based on image data at a frame frequency twice the frame frequency of input image data (such as 60 Hz) (for example, see Patent Document 3). In such a display device, a certain frame is inserted in between respective frames of input image data. Such an inserted frame is, for example, an entirely black image frame where a black image is displayed on the entire screen (black image frame). Although image blur is observed in some cases when the respective original black image frames are successively displayed in a liquid crystal display device, it is possible to insert a black image frame every single frame in order to reduce the probability of such image blur being observed. For the purpose of preventing the luminance of observed video images from lowering, a gray image frame, an entirely monochrome image where a white image is displayed on the entire screen (white image frame) or an image frame, which is generated based on original images therebefore and thereafter by interpolating processing, is employed in some cases, in place of a black image frame. Hereinbelow, a case where a display panel is driven by being supplied signals at a frame frequency twice the frame frequency of input image data is referred to double-speed drive. The gray image frame may contain a black image frame and a white image frame unless otherwise specified.

PRIOR ART DOCUMENTS

Patent Documents

Patent Document 1: JP-A-2000-111870 (Paragraphs 0026 to 0027)

Patent Document 2: JP-A-2007-93832 (Paragraphs 0003 to 0004)

Patent Document 3: JP-A-2002-41002 (Paragraphs 0003, 0004, 0041 and 0044, and FIG. 15)

DISCLOSURE OF INVENTION

Technical Problem

However, when employing such a system for preventing a reduction in visibility by controlling the luminance of a backlight, the luminance of the backlight needs to be set to a high level under a bright environment, increasing the power consumption of the display device. In a case where a single pixel is constituted by four sub-pixels in R, G, B and W, it is necessary to convert input signals of R, G and B into signals of R, G, B and W. Since such conversion is usually realized by a driving IC, it is necessary to mount a conversion circuit in the driving IC, which leads to an increase in the cost of the driving IC.

Further, although it is possible to carry out double-speed drive in order to reduce the probability of image blur being observed, displayed images are recognized as being dark when a black image frame is inserted. When a gray image frame or an image frame generated by interpolating processing is inserted as an insertion frame in place of a black image frame, displayed images are recognized as being bright. However, in, e.g. a case where input image frames are already bright images, when the images are displayed under a dark surrounding environment, the display images give an observer an adverse impression that they are too bright. In other words, it is likely to fail to maintain high display quality in accordance with a change in the illuminance of a surrounding environment.

From this point of view, it is an object of the present invention to provide a display device which is capable of maintaining, at a high level, display quality recognized by a viewer regardless of a change in the illuminance in a surrounding environment with an increase in cost minimized.

Solution to Problem

The present invention provides a display device which includes an illuminance sensor for detecting an illuminance in a surrounding environment; an input average luminance detection circuit for detecting an average luminance of input images; a frame insertion control circuit for producing a gray image frame (containing an entirely white image frame and an entirely black image frame) and inserting the produced gray image frame in between an input image frame and its subsequently input image frame; and an insertion luminance level generation circuit for determining a luminance of the gray image frame according to the illuminance detected by the illuminance sensor and the average luminance of the input images detected by the input average luminance detection circuit.

The insertion luminance level generation circuit may be configured such that when the illuminance detected by the illuminance sensor is contained in a first range of less than a first set value (corresponding to a range of less than 100 lx in the example shown in FIG. 4), the luminance of the gray image frame is set to a lower luminance than the average luminance of the input images, that when the illuminance detected by the illuminance sensor is contained in a second range of not less than the first set value and less than a second set value (corresponding to a range of not less than 100 lx and less than 1,000 lx in the example shown in FIG. 4), the luminance of the gray image frame is set to be equal to the average luminance of the input images, and that when the illuminance detected by the illuminance sensor is contained in a third range of not less than the second set value (corresponding to a range of not less than 1,000 lx in the example shown in FIG. 4), the luminance of the gray image frame is set to a luminance of not lower than the average luminance of the input images.

The insertion luminance level generation circuit may be configured such that when the illuminance detected by the illuminance sensor is contained in the first range or the third range, the luminance of the gray image frame is determined such that a value obtained by dividing the luminance of the gray image frame by the average luminance of the input images increases as the illuminance detected by the illuminance sensor increases.

The display device may further include a backlight driving circuit for driving a backlight (realized by an input luminance detection circuit 21 and a LED driver 40 in the example shown in FIG. 1), wherein the backlight driving circuit is configured such that when the illuminance detected by the illuminance sensor is less than a first boundary value (less than 10 lx in the example shown in FIG. 8), the backlight is driven so as to have a relatively lower luminance, that when the illuminance detected by the illuminance sensor is not less than the first boundary value and less than a second boundary value (a certain set value of not less than 10 lx and lower than 1,000 lx in the example shown in FIG. 8, such as less than 500 lx), the backlight is driven so as to have a relatively higher luminance, and that when the illuminance detected by the illuminance sensor is not less than the second boundary value (a certain set value of less than 1,000 lx in the example shown in FIG. 8, such as not less than 500 lx), the backlight is driven so as to have a maximized luminance.

Advantageous Effect of Invention

In accordance with the present invention, it is possible to maintain, at a high level, display quality recognized by a viewer regardless of a change in the illuminance in a surrounding environment with an increase in cost minimized.

DESCRIPTION OF EMBODIMENTS

Figure 1:
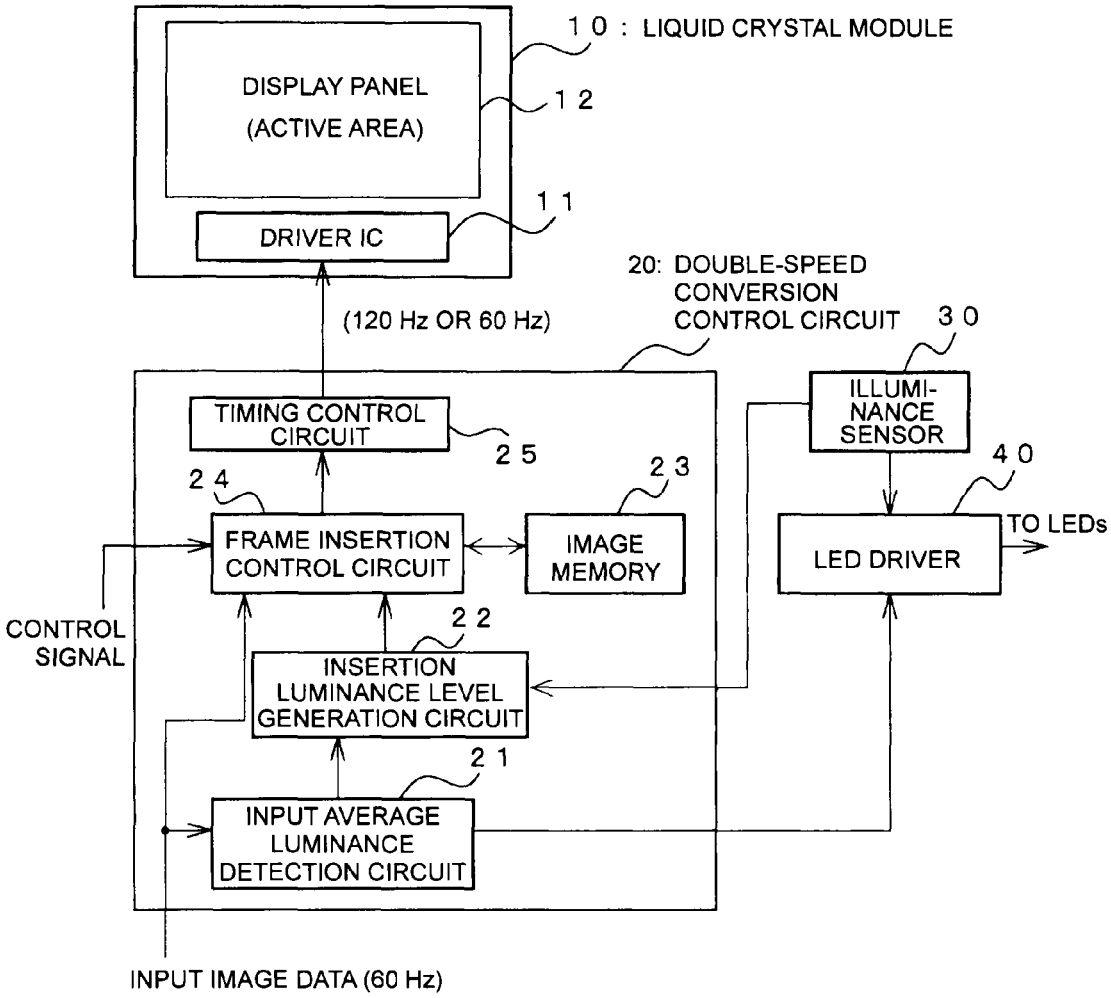
FIG. 1 is a block diagram showing the structure of a display device according to the present invention.

Now, an embodiment of the present invention will be described in reference to the accompanying drawings. FIG. 1 is a block diagram showing the structure of a display device according to the present invention. In the embodiment shown in FIG. 1, the display device includes a liquid crystal module 10 having a display panel 12 forming an active area and having a driver IC with a drive circuit mounted thereon, a double-speed conversion control circuit 20, an illuminance sensor 30 disposed in the vicinity of the liquid crystal module 10 for detecting an illuminance in the surrounding environment of the display device, and a LED driver for supplying a drive signal to a backlight (not shown) using LEDs. Although explanation of this embodiment will be made about a case where the backlight uses LEDs, it is not essential that the backlight uses LEDs.

The display panel having pixels in the liquid crystal module 10 is, e.g. an active matrix type liquid crystal display panel. The liquid crystal display panel has a plurality of row electrodes and a plurality of column electrodes disposed such that one of a group constituted by the row electrodes and a group constituted by the column electrodes passes over the other group.

The double-speed conversion control circuit 20 includes an input average luminance detection circuit 21 for detecting an average luminance (APL) of input images based on calculation of input image data, an insertion luminance level generation circuit 22 for determining the luminance of an insertion frame to be inserted in between the input image frames based on the illuminance detected by the illuminance sensor 30 and the value of the APL calculated by the input average luminance detection circuit 21, an image memory 23 for temporarily storing the input image data, a frame insertion control circuit 24 for alternately outputting the insertion frame and frames produced based on the input image data (input image frames) when a control single indicative of double-speed drive is input, and for outputting only the input image data when no control single indicative of double-speed drive is input, and a timing control circuit 25 for outputting respective signals given to electrodes disposed in the display panel 12 of the liquid crystal module 10. It should be noted that the respective signals are actually applied to the electrodes through the driver IC 11.

The control signal indicative of double-speed drive is output from, e.g. a control unit of equipment with the display device incorporated therein. For example, the equipment turns on the control signal indicative of double-speed drive when a switch disposed in the equipment is set in a double-speed state.

In the embodiment shown in FIG. 1, the input average luminance detection circuit 21 constantly executes processing for finding such an APL, and the insertion luminance level generation circuit 22 constantly executes processing for determining the luminance of an insertion frame. However, the input average luminance detection circuit 21 and the insertion luminance level generation circuit 22 may be configured to execute their processing only when receiving the control signal indicative of double-speed drive, which is like the frame insertion control circuit 24 is configured to execute the double-speed drive only when receiving the control signal indicative of double-speed drive.

In this embodiment, the input image data is supposed to be data where the lightness of each of R, G and B is represented by a certain number of bits (such as six bits) for example.

Next, the basic control operation in the display device according to the present invention will be described. In the present invention, when it is commanded that luminance control is carried out according to an environment, the electrodes disposed in the display panel 12 are driven by a frame frequency (such as 120 Hz) that is twice the frequency of the input image frames (such as 60 Hz). At that time, the double-speed conversion control circuit 20 produces a frame having a certain luminance and inserts the frame having such a certain luminance, i.e. an insertion frame before or after an original input image frame. The insertion frame is a gray image having all pixels set to the same luminance (containing an entirely black image or an entirely white image). Herebelow, the insertion frame is referred to as the gray frame at some places. When it is not commanded that the luminance control is carried out according to an environment, the electrodes disposed in the display panel 12 are driven based on only input image frames.

Figure 2:
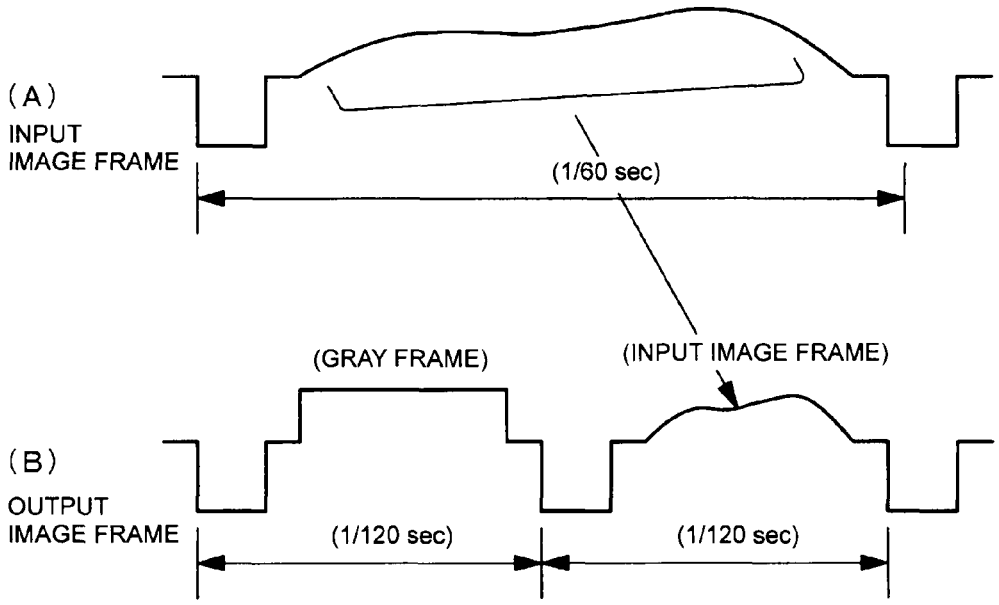
FIGS. 2(A) and (B) are waveform charts showing a relationship between an input image frame and an output image frame.

As shown in the waveform charts of FIGS. 2(A) and (B), the double-speed conversion control circuit 20 produces a gray frame having a length of 1/120 sec as shown in FIG. 2(B) with respect to a single input image frame input at a cycle of 1/60 sec (see FIG. 2(A)). In a period of 1/60 sec, the gray frame and the input image frame are output to the liquid crystal module 10.

Figure 3:
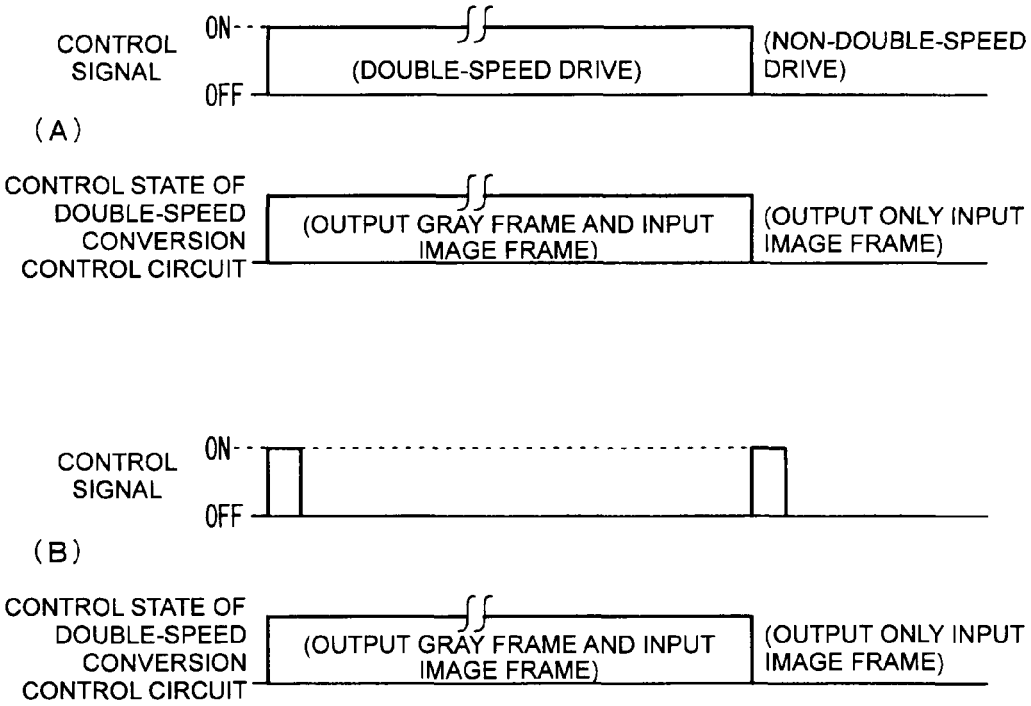
FIGS. 3(A) and (B) are illustrative views showing a relationship between a control signal and the control state of a double-speed conversion control circuit.

It should be noted that the state where the luminance control is carried out according to an environment is maintained by the control signal indicative of double-speed drive. In other words, the state where the luminance control is carried out according to an environment corresponds to a state where the control signal indicative of double-speed drive is output as shown in the illustrative view of FIG. 3(A). In the explanation below, it is assumed that the control signal indicative of double-speed drive is maintained in an ON state in a period where it is commanded that the luminance control is carried out according to an environment, and that the control signal indicative of double-speed drive is maintained in an OFF state in a period where it is not commanded that the luminance control is carried out according to an environment. However, as shown in FIG. 3(B), the basic control operation may be configured such that a control signal in the form of a single pulse triggers the start of the luminance control according to an environment and that when another control signal in the form of a single pulse is input in a period where the luminance control is carried out according to the environment, the state where the luminance control is carried out according to the environment (state where the double-speed drive is carried out) is shifted to a state where no luminance control is carried out (state where only input image frames are employed).

Figure 4:
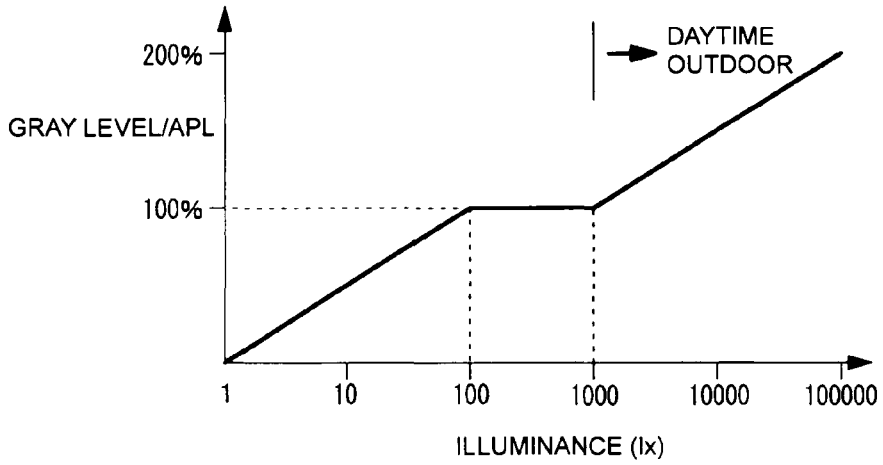
FIG. 4 is an illustrative view showing an example of the relationship between an illuminance detected by an illuminance sensor and the luminance of an inserted frame.

FIG. 4 is an illustrative view showing an example of the relationship between an illuminance detected by the illuminance sensor 30 and the luminance of an insertion frame (gray frame). In FIG. 4, the horizontal axis indicates an illuminance detected by the illuminance sensor 30, and the vertical axis indicates the luminance of an insertion frame. In FIG. 4, the scale of the horizontal axis is a logarithmic scale. In FIG. 4, the luminances of the gray frame are represented by a relative value of luminance with respect to the APL of input images. Hereinbelow, when the luminance with respect to the APL of input images is referred to in a relative value, the wording "luminance (relative value)" is used.

In the example shown in FIG. 4, when the illuminance detected by the illuminance sensor 30 is less than 100 lx, the luminance (relative value) of a gray frame is set so as to monotonically increase with respect to illuminances. When the illuminance detected by the illuminance sensor is 0, a gray frame is set as an entirely black frame. When the illuminance detected by the illuminance sensor 30 is not less than 100 lx and less than 1,000 lx, the luminance (relative value) of a gray frame is set to 100% of the APL of input images, i.e. the same value as the APL of input images. When the illuminance detected by the illuminance sensor 30 is not less than 1,000 lx, the luminance (relative value) of a gray frame is set to a value of not less than 100% of the APL of input images and monotonically increasing with respect to illuminances.

The insertion luminance level generation circuit 22 receives, as inputs, the illuminance detected by the illuminance sensor 30 and the APL detected by the input average luminance detection circuit 21 and may determine the luminance of the insertion frame based on the relationship exemplified in FIG. 4.

As shown in FIG. 4, when the illuminance detected by the illuminance sensor 30 is relatively low, the luminance of a gray frame to be inserted is set to be relatively low. When the illuminance detected by the illuminance sensor 30 is relatively moderate (for example, an average indoor environment), the luminance of a gray frame to be inserted is set to the same value as the APL of input images. When the illuminance detected by the illuminance sensor 30 is relatively high, the luminance of a gray frame to be inserted is set to be relatively high.

When the display panel is operated under the double-speed drive, a gray frame is displayed every one frame on the display panel of the liquid crystal module 10, i.e. each input image frame and a gray frame are alternately displayed whereby when the illuminance detected by the illuminance sensor 30 is low, the luminance of watched video images is reduced from the average luminance of the input images. In other words, the screen of the display panel becomes an easy-to-watch screen to a viewer since the luminance of the screen of the display panel is set to a lower value under a dark environment. When the illuminance detected by the illuminance sensor 30 is relatively moderate, the luminance of watched video images becomes substantially the same as the average luminance of the input images. When the illuminance detected by the illuminance sensor 30 is relatively high, the luminance of watched video images becomes higher than the average luminance of the input images. In other words, the screen of the display panel becomes an easy-to-watch screen to a viewer since the luminance of the screen of the display panel is set to a higher value under a bright environment.

It should be noted that the numerical values (in particular, the numerical values of the horizontal axis) shown in FIG. 4 are indicated as one example. Although a range of less than 100 lx and a range of not less than 1,000 lx in the example shown in FIG. 4 are ranges where the luminance (relative value) of a gray frame increases, the boundary between each of the ranges where the luminance (relative value) of a gray frame increases and a range where the luminance (relative value) of a gray frame does not change (100 lx and 1,000 lx in the example shown in FIG. 4) may be different from the example shown in FIG. 4. For example, a certain first set value (100 lx in the example shown in FIG. 4) may be set to 10 lx.

When the luminance (relative value) of a gray frame is set as shown in FIG. 4, backlight control described later is not taken into account. When the luminance control is combined with the backlight control, the boundary between each of the ranges where the luminance (relative value) of a gray frame increases and the range where the luminance (relative value) of a gray frame does not change (100 lx and 1,000 lx in the example shown in FIG. 4) may be different from the example shown in FIG. 4, or the inclination of the straight line indicating the luminance (relative value) of a gray frame may be different from that in the example shown in FIG. 4.

Figure 5:
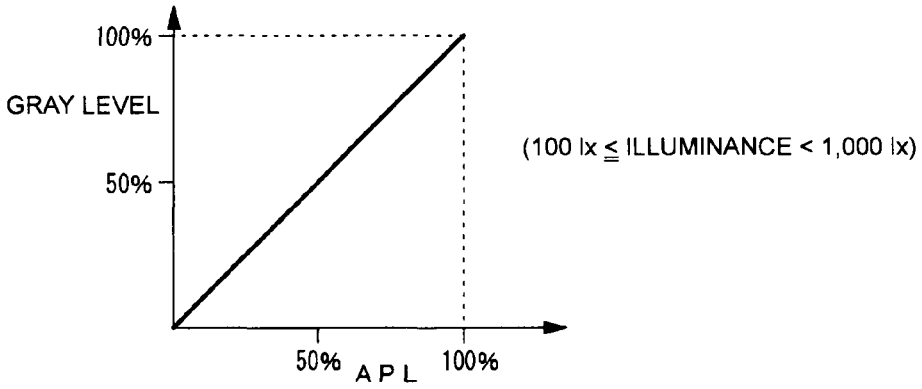
FIG. 5 is an illustrative view illustrating a relationship between an APL and the luminance of a gray frame according to differences in illuminances.
Figure 6:
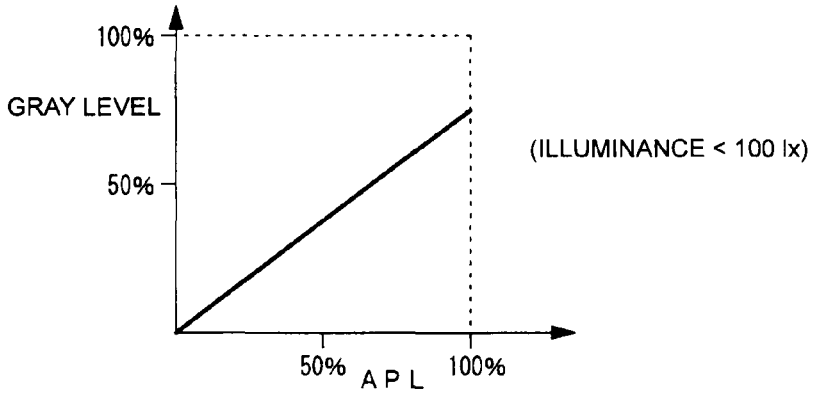
FIG. 6 is an illustrative view illustrating a relationship between an APL and the luminance of a gray frame according to differences in illuminances.
Figure 7:
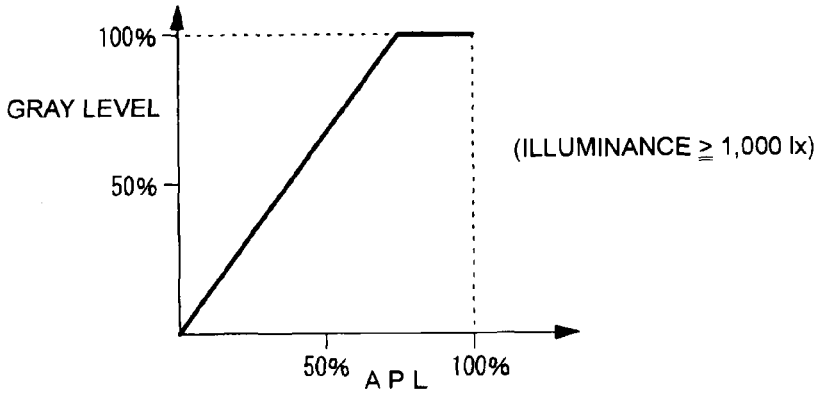
FIG. 7 is an illustrative view illustrating a relationship between an APL and the luminance of a gray frame according to differences in illuminances.

Each of FIGS. 5 to 7 is an illustrative view illustrating a relationship between an APL and the luminance of a gray frame according to differences in illuminances. In each of FIGS. 5 to 7, the horizontal axis indicates the value of an APL with respect to the maximum luminance (the luminance of a white image), and the vertical axis indicates the value of the luminance of a gray frame with respect to the maximum luminance (the luminance of the white image). When the illuminance detected by the illuminance sensor 30 is not less than 100 lx and less than 1,000 lx, the luminance of a gray frame is set to the same value as the APL of input images as shown in FIG. 5. When the illuminance detected by the illuminance sensor 30 is less than 100 lx, the luminance of a gray frame is set to a smaller value than the APL of input images as shown in FIG. 6. When the illuminance detected by the illuminance sensor 30 is not less than 1,000 lx, the luminance of a gray frame is set to a larger value than the APL of input images as shown in FIG. 7. Needless to say, when the luminance of a gray frame has reached the maximum value, in other words, when a gray frame has become an entirely white frame, the luminance of the gray frame stays in the maximum value even if the value of the APL further increases.

Figure 8:
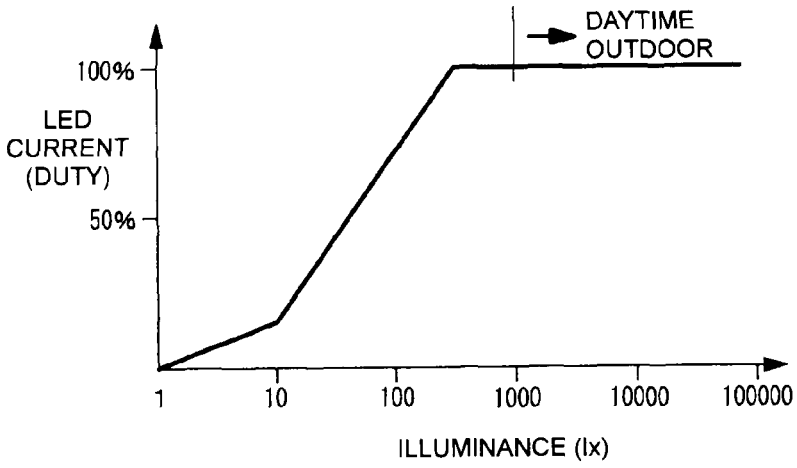
FIG. 8 is an illustrative view showing an example of the relationship between an illuminance detected by an illuminance sensor and a drive current for LEDs.
Figure 9:
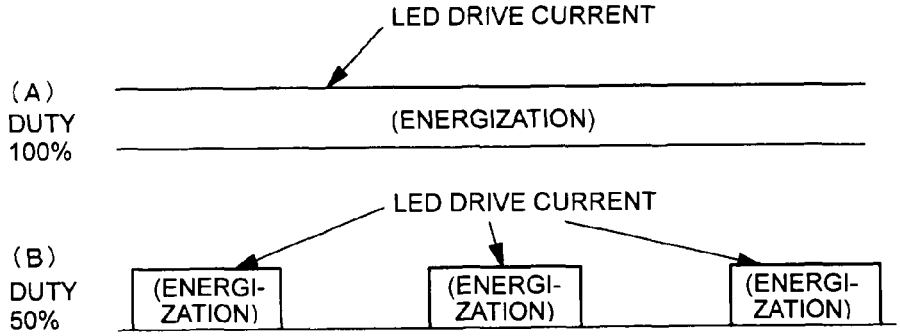
FIGS. 9(A) and (B) are illustrative views illustrating the drive current of the LEDs.

FIG. 8 is an illustrative view showing an example of the relationship between an illuminance detected by the illuminance sensor and a drive current for LEDs. In FIG. 8, the horizontal axis indicates an illuminance detected by the illuminance sensor, and the vertical axis indicates a drive current of the LEDs. It should be noted that the scale of the horizontal axis is a logarithmic scale. In FIG. 8, the drive current for the LEDs is represented by a period of time for energizing the LEDs. In this embodiment, the luminance of the backlight is adjusted by controlling the period of time for energizing the LEDs. Specifically, when the luminance of the backlight needs to be maximized, the LEDs are constantly energized as shown in the illustrative view of FIG. 9(A). In other words, the duty is set to 100%. When the luminance of the backlight needs to be reduced, the period of time for energizing the LEDs is accordingly controlled as shown in FIG. 9(B). FIG. 9(B) shows a case where the total period of time for energizing the LEDs is half of the entirety (the duty is set to 50%).

The LED driver 40 receives, as an input, an illuminance detected by the illuminance sensor 30, and may determine the drive current of the LEDs (the duty in this example) based on the relationship exemplified in FIG. 8.

In the example shown in FIG. 8, when the illuminance detected by the illuminance sensor 30 is less than 10 lx, the drive current for the LEDs is controlled so as to be reduced in order to lower the luminance of the backlight. The drive current for the LEDs is also controlled so as to monotonically increase with respect to illuminances. When the illuminance detected by the illuminance sensor 30 is a certain set value of not less than 10 lx and less than 1,000 lx (such as less than 500 lx), the drive current for the LEDs is controlled so as to increase in order to raise the luminance of the backlight in comparison with a case where the illuminance is less than 10 lx. The drive current for the LEDs is also controlled so as to monotonically increase with respect to luminances. When the illuminance detected by the illuminance sensor 30 is not less than a certain set value of lower than 1,000 lx (such as not less than 500 lx), the drive current for the LEDs is maximized.

Figure 10:
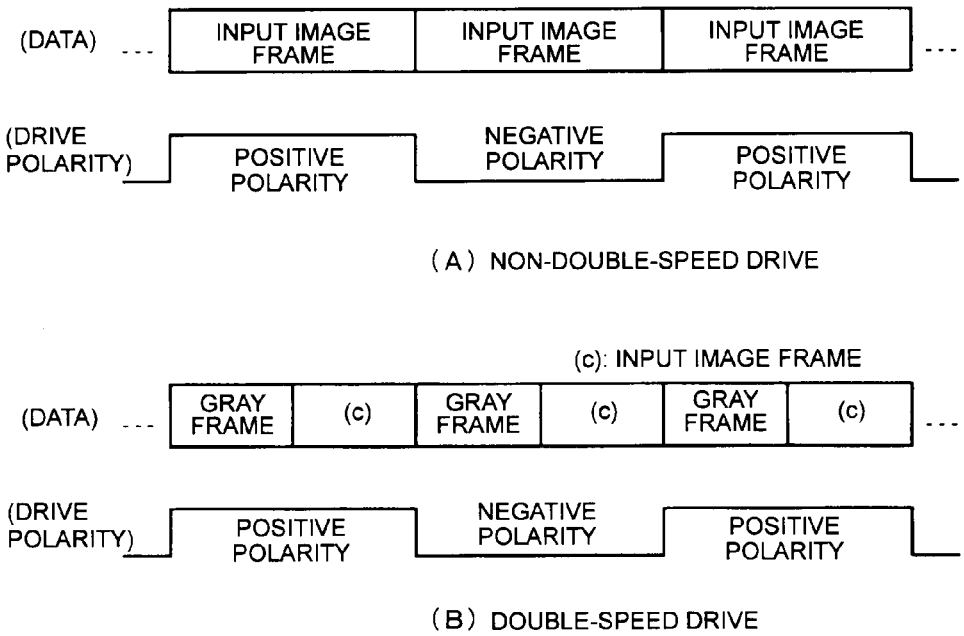
FIGS. 10(A) and (B) are illustrative view illustrating the polarity in a pixel when the display panel of a display device according to the present invention is driven.

FIGS. 10(A) and (B) are illustrative view illustrating the polarity in a pixel when the display panel of a display device according to the present invention is driven. In non-double-speed drive, the polarity of the drive current is reversed every one frame as shown in FIG. 10(A). In the double-speed drive, the polarity of the drive current may be reversed every two frames (every one unit of one gray frame and one input image frame) as shown in FIG. 10(B).

When the polarity of the drive current is reversed every one frame (a cycle of 1/120 sec) in the double-speed drive, an input image and an insertion image following the input image have different polarities, causing the selection period of time to be halved. As a result, it is likely that discharge and charge are insufficient. From this point of view, it is preferred to reverse the polarity of the drive current every two frames as shown in FIG. 10(B).

In order to realize the polarity reverse as shown in FIGS. 10(A) and (B), the timing control circuit 25 is configured, for example, to output a polarity reverse signal indicative of a polarity for drive such that the polarity of the polarity reverse signal changes at the start of each frame in the non-double-speed drive and that the polarity of the polarity reverse signal changes at the start of (2n+1)th frame (n: 0 or a natural number) in the double-speed drive.

Figure 11:
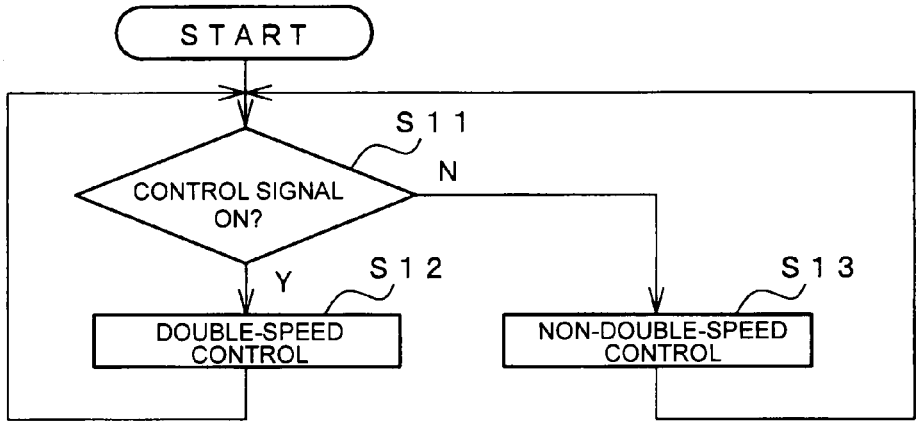
FIG. 11 is a flowchart showing the operation of the double-speed conversion control circuit.

Next, the operation of the double-speed conversion control circuit 20 will be described in reference to the flowchart shown in FIG. 11 and the schematic timing charts shown in FIGS. 12(A) to (F).

In the double-speed conversion control circuit 20, the frame insertion control circuit 24 execute double-speed drive control when the control signal indicative of double-speed is turned on (Steps S11 and S12). When the control signal indicative of double-speed drive is not turned on, the frame insertion control circuit executes non-double-speed drive control (Steps S11 and S13).

The non-double-speed drive control is drive control which does not execute the insertion of a gray frame, and normal drive control wherein when input image frames are input at a frequency of, e.g. 60 Hz, the liquid crystal module 10 is driven based on image data contained in the input image frames at 60 Hz.

FIGS. 12(A) to (F) are schematic timing charts showing schematic timing of each of the double-speed control and the backlight control. In FIGS. 12(A) to (F), the horizontal direction indicates the lapse of time.

Figure 12:
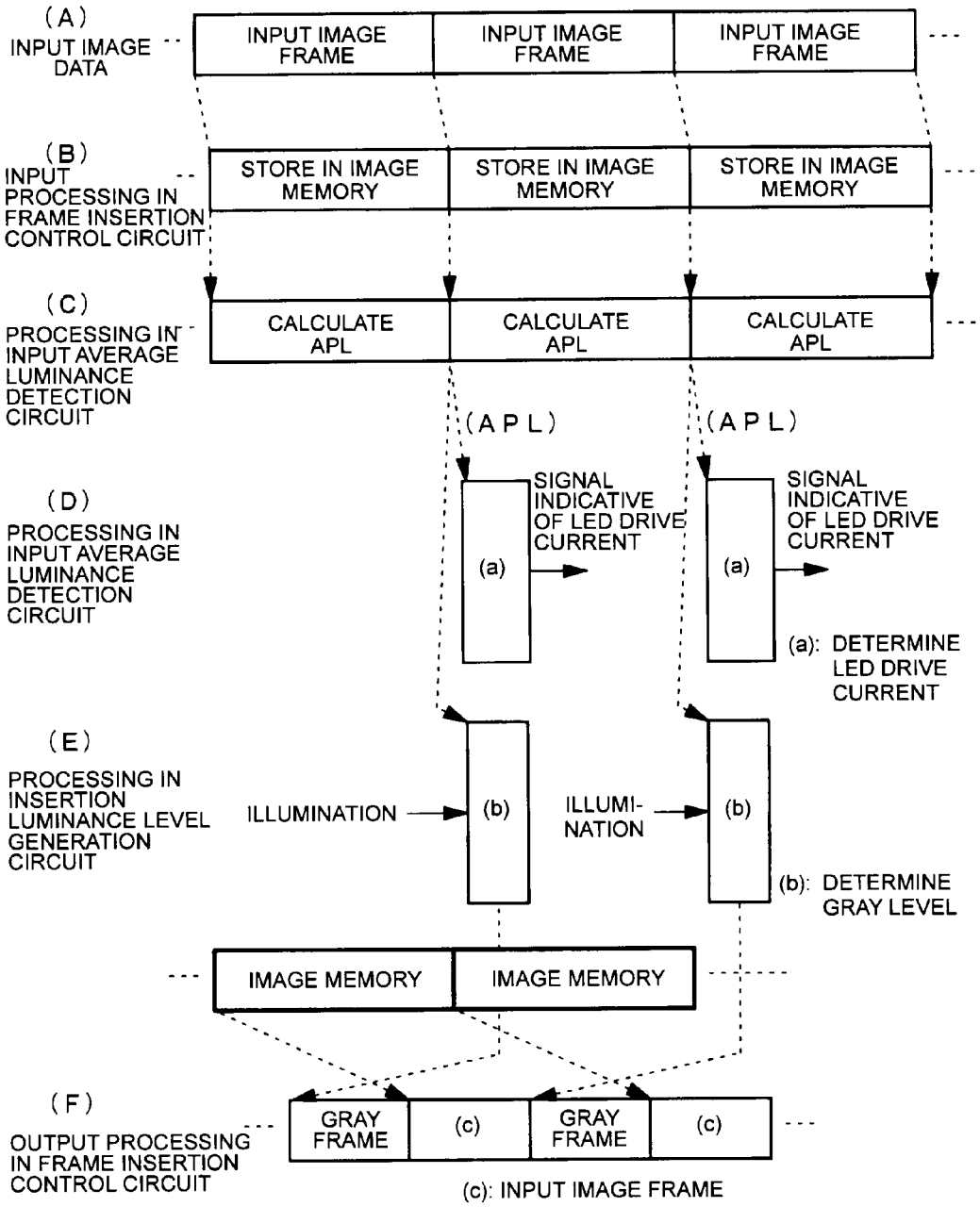
FIGS. 12(A) to (F) are schematic timing charts showing schematic timing of double-speed drive control and backlight control.

When input image frames are input (see FIG. 12(A)), the input image frames are input in the input average luminance detection circuit 21 and the frame insertion control circuit 24 as shown in FIGS. 12(A) to (F). The frame insertion control circuit 24 temporarily stores in the image memory 23 image data contained the input image frames (see FIG. 12(B)).

The input average luminance detection circuit 21 calculates the APL of the input image frames (see FIG. 12(C)). For example, the APL is calculated by adding up the luminance values of the respective pixels of each image frame and dividing the total luminance value by the number of the pixels. The input average luminance detection circuit 21 may utilize any method for calculating the APL.

The input average luminance detection circuit 21 determines the drive current for the LEDs as the backlight according to each calculated APL (see FIG. 12(D)). At that time, the input average luminance detection circuit 21 may determine the drive current for the LEDs as exemplified in FIG. 8. In other words, when the illuminance detected by the illuminance sensor 30 based on input data showing an illuminance is less than 10 lx, the drive current for the LEDs is controlled so as to be reduced in order to decrease the drive current for the backlight (specifically, the period of time for energizing the LEDs). At that time, the drive current for the LEDs is also controlled so as to be set to a value which monotonically increases with respect to illuminances. When the illuminance detected by the illuminance sensor 30 is a certain set value of not less than 10 lx and less than 1,000 lx (such as less than 500 lx), the drive current for the LEDs is controlled so as to increase in comparison with a case where the illuminance detected by the illuminance sensor is less than 10 lx. At that time, the drive current (specifically, the duty) is also controlled so as to monotonically increase with respect to illuminances. When the illuminance detected by the illuminance sensor 30 is not less than a certain set value of lower than 1,000 lx (such as not less than 500 lx), the drive current for the LEDs is maximized.

The input average luminance detection circuit 21 outputs data indicative of the determined drive current (specifically, data indicative of the determined duty) to the LED driver 40.

The LED driver 40 includes a circuit for controlling the period of time for energizing the LEDs according to the data indicative of the determined drive current. In other words, the LED driver includes a circuit for controlling the duty of the drive current. The LED driver 40 supplies a drive current to the LEDs with the duty according to the data output from the input average luminance detection circuit 21.

In accordance with the control carried out by the input average luminance detection circuit 21 and the LED driver 40 described above, when the surrounding environment of the display device is dark, the luminance of the backlight is reduced whereby it is easy for a viewer to watch the screen of the liquid crystal module 10. When the display device is supposed to be present in a room or the like (for example, when the illuminance in a surrounding environment of the display device is from 10 to 1,000 lx), the luminance of the backlight is slightly raised. Under a bright environment as in daytime outdoor, the luminance of the backlight is maximized whereby a viewer is allowed to easily watch the screen of the liquid crystal module 10.

The insertion luminance level generation circuit 22 determines the luminance of a gray frame to be inserted (gray level) based on the APL calculated by the input average luminance detection circuit 21 and the illuminance detected by the illuminance sensor 30 (see FIG. 12(E)). At that time, the insertion luminance level generation circuit 22 may determine the gray level as exemplified in FIG. 4.

In other words, the surrounding environment of the display is dark, for example when the illuminance detected by the illuminance sensor 30 is less than 100 lx, the gray level (relative value) is determined to be a value which monotonically increases with respect to illuminances. When the illuminance detected by the illuminance sensor is 0, an entirely black image is selected as the gray level. When the display is supposed to be present in a room or the like, for example when the illuminance detected by the illuminance sensor 30 is not less than 100 lx and less than 1,000 lx, the gray level (relative value) is determined to be set to the same value of the APL of the input images. Under a bright environment as in daytime outdoor, for example when the illuminance detected by the illuminance sensor 30 is not less than 1,000 lx, the gray level (relative value) is determined to be set to a value which is not less than the APL of the input images and monotonically increases with respect to illuminances. It should be noted that the gray level (relative value) is a ratio to the APL.

The insertion luminance level generation circuit 22 calculates the absolute value of a gray level based on the determined gray level (relative value) and the APL of the input images. Then, the calculated absolute value of the gray level is outputted as a value indicative of the gray level to the frame insertion control circuit 24 by the insertion luminance level generation circuit 22.

In a period of time for outputting a gray frame, the data corresponding to the entire pixels containing respective subpixels of R, G and B is converted into gray level values output from the insertion luminance level generation circuit 22 and is output in the form of conversion to the timing control circuit 25 by the frame insertion control circuit 24 (see FIG. 12(F)). On the other hand, in a period of time for outputting an input image frame, image data is read out from the image memory 23 and is output to the timing control circuit 25 by the frame insertion control circuit (see FIG. 12(F)).

The timing control circuit 25 outputs signals indicative of the start of the respective frames, polarity reverse signals, clock signals, data signals of R, G and B, and the like to the liquid crystal module 10.

By executing the above-mentioned control, an insertion frame having a gray level corresponding to the illuminance of a surrounding environment of the display device and to the luminances of input image frames per se is inserted in between respective input image frames in the double-speed drive. For example, when the surrounding environment has a low illuminance, an insertion frame, which has a lower luminance than the APL of input image frames, is inserted. When the display is present in a room or the like, an insertion frame, which has a luminance of substantially the same level as the APL of input image frames, is inserted. When the display is present outdoors or in a similar place, an insertion frame, which has a higher luminance than the APL of input image frames, is inserted.

Accordingly, a viewer can constantly watch images having a high display quality regardless of any environment where the display device is present.

In the above-mentioned embodiment, a commonly available driver IC can be adopted as the driver IC 11 since the double-speed conversion control circuit 20 is disposed outside the driver IC 11.

Although the double-speed drive control and the backlight control based on illumination are combined in the above-mentioned embodiment, only the double-speed drive control may be carried out. However, the gray level in the double-speed drive control can be more finely set when the backlight control based on illuminance is combined with the double-speed drive control. For example, the gray level can be more finely set by reducing the inclination of the straight line in a range of not less than 1,000 lx in the gray level (relative value) exemplified in FIG. 4 in comparison with the inclination of the straight line shown in FIG. 4, since the luminance of display can be raised by the backlight control based on illuminance.

Although a commonly available driver IC can be adopted as the driver IC 11 when the double-speed conversion control circuit 20 is disposed outside the driver IC 11 as described above, the function of the double-speed conversion control circuit 20 may be incorporated into such a driver IC. In other words, an LSI with the function of the double-speed conversion control circuit 20 and the function of the driver IC 11 incorporated thereinto may be used.

Although the above-mentioned embodiment has been described about a case where the double-speed drive is carried out such that the electrodes disposed in the display panel 12 are driven by a frame frequency (such as 120 Hz) that is twice the frequency of input image frames (such as 60 Hz), quadruple-speed drive wherein the electrodes disposed in the display panel 12 are driven by a frequency (such as 240 Hz) that is quadruple frequency of input image frames (such as 60

Hz) may be carried out. When the quadruple-speed drive is carried out, one of the four frames is formed by an input image frame, one of the remaining three frames is formed by a gray frame, and each of the further remaining frames are formed by an interpolated image or a gray frame.

Although an achromatic gray frame is utilized in the above-mentioned embodiment, the luminance insertion level generation circuit 22 may be configured so as to output R, G and B data with intensity being slightly added to gray when primary intensity is detected by a circuit for detecting an intensity dominant in input image frames.

Although the above-mentioned embodiment has been described about a case where the liquid crystal module 10 has an active matrix driving type liquid crystal display panel, the present invention is also applicable to a liquid crystal module having a passive matrix type liquid crystal display panel.

INDUSTRIAL APPLICABILITY

The present invention is advantageously applied to a display device in equipment also used outdoors, an instrument or the like in the instrument panel of an automobile, an information display and so on.

This application is a continuation of PCT Application No. PCT/JP2010/064098, filed Aug. 20, 2010, which is based upon and claims the benefit of priority from Japanese Patent Application No. 2009-199174 filed on Aug. 31, 2009. The contents of those applications are incorporated herein by reference in its entirety.

What is claimed is:

1. A display device comprising:

an illuminance sensor that detects an illuminance in a surrounding environment;

an input average luminance detection circuit that detects an average luminance of input images;

a frame insertion control circuit that produces a gray image frame and inserts the produced gray image frame into between an input image frame and its subsequently input image frame; and an insertion luminance level generation circuit that determines a luminance of the gray image frame according to the illuminance detected by the illuminance sensor and the average luminance of the input images detected by the input average luminance detection circuit, wherein the insertion luminance level generation circuit is configured such that when the illuminance detected by the illuminance sensor is contained in a first range of less than a first set value, the luminance of the gray image frame is set to a lower luminance than the average luminance of the input images, that when the illuminance detected by the illuminance sensor is contained in a second range of not less than the first set value and less than a second set value, the luminance of the gray image frame is set to be equal to the average luminance of the input images, and that when the illuminance detected by the illuminance sensor is contained in a third range of not less than the second set value, the luminance of the gray image frame is set to a luminance of not lower than the average luminance of the input images; and when the illuminance detected by the illuminance sensor is contained in the first range or the third range, the luminance of the gray image frame is determined such that a value obtained by dividing the luminance of the gray image frame by the average luminance of the input images increases as the illuminance detected by the illuminance sensor increases.

2. The display device according to claim 1, further comprising a backlight driving circuit that drives a backlight;

wherein the backlight driving circuit is configured such that when the illuminance detected by the illuminance sensor is less than a first boundary value, the backlight is driven so as to have a relatively lower luminance, that when the illuminance detected by the illuminance sensor is not less than the first boundary value and less than a second boundary value, the backlight is driven so as to have a relatively higher luminance, and that when the illuminance detected by the illuminance sensor is not less than the second boundary value, the backlight is driven so as to have a maximized luminance.

3. The display device according to claim 1, wherein the insertion luminance level generation circuit determines a luminance of the gray image frame so that the value increases monotonically with respect to the illuminance expressed on a logarithmic scale.

4. The display device according to claim 1, wherein the luminance of the backlight is changed by changing a period of time for energizing the backlight.

5. A display device comprising:

a means for detecting an illuminance in a surrounding environment;

a means for detecting an average luminance of input images;

a means for producing a gray image frame and inserting the produced gray image frame into between an input image frame and its subsequently input image frame; and a means for determining a luminance of the gray image frame according to the illuminance detected by the means for detecting the illuminance and the average luminance of the input images detected by the means for detecting the average luminance so that a value obtained by dividing the luminance of the gray image frame by the average luminance of the input images increases as the illuminance detected by the means for detecting the illuminance increases, wherein the means for determining the luminance is configured such that when the illuminance detected by the means for detecting the illuminance is contained in a first range of less than a first set value, the luminance of the gray image frame is set to a lower luminance than the average luminance of the input images, that when the illuminance detected by the means for detecting the illuminance is contained in a second range of not less than the first set value and less than a second set value, the luminance of the gray image frame is set to be equal to the average luminance of the input images, and that when the illuminance detected by the means for detecting the illuminance is contained in a third range of not less than the second set value, the luminance of the gray image frame is set to a luminance of not lower than the average luminance of the input images; and when the illuminance detected by the means for detecting the illuminance is contained in the first range or the third range, the luminance of the gray image frame is determined such that the value obtained by dividing the luminance of the gray image frame by the average luminance of the input images increases as the illuminance detected by the means for detecting the illuminance increases.

* * * * *